US005437954A

United States Patent [19]

Saito

[11] Patent Number: 5,437,954

[45] Date of Patent: Aug. 1, 1995

[54] TONER COMPOSITION FOR ELECTROPHOTOGRAPHY WITH ZINC OXIDE ADDITIVE

[75] Inventor: Susumu Saito, Minami-ashigara, Japan

[73] Assignee: Fuji Xerox Co., Ltd., Tokyo, Japan

[21] Appl. No.: 197,341

[22] Filed: Feb. 16, 1994

[30] Foreign Application Priority Data

Feb. 17, 1993 [JP] Japan ..... 5-049924

[51] Int. Cl.[6] ..... G03G 9/08

[52] U.S. Cl. ..... 430/110; 430/111; 430/903

[58] Field of Search ..... 430/110, 903

[56] References Cited

U.S. PATENT DOCUMENTS

| | | | |
|---|---|---|---|
| 4,740,443 | 4/1988 | Nakahara et al. | 430/110 X |
| 4,882,258 | 11/1989 | Ikeuchi et al. | 430/109 X |
| 4,935,782 | 6/1990 | Kohyama | 430/110 X |
| 5,292,609 | 3/1994 | Yoshikawa et al. | 430/110 |
| 5,296,324 | 3/1994 | Akagi et al. | 430/110 X |

FOREIGN PATENT DOCUMENTS

| | | | |
|---|---|---|---|
| 63-271476 | 11/1988 | Japan . | |
| 4-40467 | 2/1992 | Japan . | |
| 4-93952 | 3/1992 | Japan . | |
| 204750 | 7/1992 | Japan | 430/110 |

OTHER PUBLICATIONS

Hackh's Chemical Dictionary, 1969, p. 168.

*Primary Examiner*—Roland Martin
*Attorney, Agent, or Firm*—Oliff & Berridge

[57] ABSTRACT

An electrophotographic toner composition comprising toner particles composed of a binder resin and a colorant and fine particles adhered to the surface of the toner particles is disclosed, in which said fine particles are zinc oxide fine particles having an average particle size of from 2 to 100 nm and having been surface-treated with a silane coupling agent or a silicone oil. The toner composition is excellent in charging properties, such as chargeability, environmental stability of chargeability, and toner admixing properties.

19 Claims, No Drawings

TONER COMPOSITION FOR ELECTROPHOTOGRAPHY WITH ZINC OXIDE ADDITIVE

FIELD OF THE INVENTION

This invention relates to an electrophotographic toner composition which can be used for development of an electrostatic latent image in electrophotography and electrostatic recording.

BACKGROUND OF THE INVENTION

Developers in common use for visualizing an electrostatic latent image formed on an electrophotographic photoreceptor include one-component developers comprising toner particles prepared by melt-kneading a binder resin, such as polystyrene, a styrene-butadiene copolymer or polyester, and a pigment or a dye as a colorant and grinding the mixture and two-component developers prepared by mixing toner particles with a carrier having an average particle size approximately equal to that of the toner or a greater size of up to 500 μm, such as glass beads, iron powder, nickel powder or ferrite powder which may be coated with various resins.

When used as such, the above-described developers are insufficient in preservability (antiblocking properties), fluidity, developing properties, transfer properties, charging properties, and the like. It is therefore a practice usually followed to externally add additives thereto for improving these characteristics. Additives hitherto proposed include hydrophobic fine powders typically exemplified by hydrophobic silica (see JP-A-56-128956, the term "JP-A" as used herein means an "unexamined published Japanese patent application"), silica fine particles combined with aluminum oxide powder, titanium oxide powder, etc. (see JP-A-60-238847), titanium oxide having been made hydrophobic (see JP-A-59-52255), and aluminum oxide-coated titanium oxide fine particles (see JP-A-57-79961). As a modification of titanium oxide particles, those having an anatase structure have been proposed (see JP-A-60-112052).

Addition of hydrophobic fine powders, such as hydrophobic silica, which is a frequently followed practice, improves preservability, fluidity, developing properties, and transfer properties to considerable degrees. However, use of hydrophobic fine powders in an amount enough to obtain improvements adversely affects the charging properties of a developer. To have satisfactory charging properties is to satisfy such requirements as to a quantity of charge, a rate of charging, a charge distribution, toner admixing properties, and environmental stability of charging. Of these charging properties, a rate of charging, a charge distribution, toner admixing properties, and environmental stability are adversely influenced by addition of silica, etc.

Mixing of alumina or titanium oxide fine particles with silica fine particles, which aims at improvements in charging rate, charge distribution, admixing properties, and environmental stability, is accompanied by a considerable reduction in quantity of charge. Moreover, the latitude for meeting various charging properties is very narrow, the improvements achieved are still insufficient, and, in particular, deterioration of environmental stability of chargeability results.

Where rutile or anatase titanium oxide is used as an additive, because it is hardly chargeable as such, it should be rendered hydrophobic by coating with alumina, etc. or by treating with a coupling agent. However, alumina-coated titanium oxide particles are not always prevented from agglomeration and also have insufficient dispersibility when added to a toner. Coupling agent-treated ones show some improvement in charging properties but are still insufficient.

On the other hand, where a polyester resin is used as a binder resin for toner particles, because a polyester resin itself possesses negative chargeability, it is received that negative chargeability is secured with no or little amount of a charge control agent being used. However, a polyester resin is disadvantageous in that the quantity of charge greatly varies with environmental changes between a high temperature and high humidity condition and a low temperature and low humidity condition. The disadvantage is especially pronounced when a pigment other than carbon black is used as a colorant.

While not clear, negative chargeability of a polyester resin is assumed to be attributed to the polar group thereof, a carbonyl ester group. It is accepted that the chargeability of the polar group is easily influenced by changes in temperature and humidity so that a toner containing the resin is also susceptible to the influences of the environment. Besides, even with a charge control agent added to a polyester resin, the environmental stability of chargeability cannot be improved markedly.

Hence, toners using a polyester resin as a binder have not reached satisfactory results in terms of environmental stability of chargeability.

SUMMARY OF THE INVENTION

An object of the present invention is to provide an electrophotographic toner composition excellent in chargeability, environmental stability of charging properties, toner admixing properties, and the like.

Another object of the present invention is to provide an electrophotographic toner composition which maintains a sharp charge distribution even after long-term running.

As a result of extensive investigations, the present inventors have found that the above objects of the present invention are accomplished by using a surface-treated zinc oxide fine particles as an external additive.

The present invention provides an electrophotographic toner composition comprising toner particles composed of a binder resin and a colorant and fine particles adhered to the surface of the toner particles, in which said fine particles are zinc oxide fine particles having an average particle size of from 2 to 100 nm and having been surface-treated with a silane coupling agent or a silicone oil.

DETAILED DESCRIPTION OF THE INVENTION

The colorants which can be used in the present invention typically include carbon black, Nigrosine, Aniline Blue, Chalcoyl Blue, Chrome Yellow, Ultramarine Blue, Du Pont Oil Red, Quinoline Yellow, Methylene Blue chloride, Phthalocyanine Blue, Malachite Green oxalate, lamp black, Rose Bengale, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3.

The binder resins which can be used in the present invention include homo- or copolymers of styrene or derivatives thereof, e.g., chlorostyrene; monoolefins, e.g., ethylene, propylene, butylene, and pentylene; dienes, e.g., butadiene and isoprene; vinyl esters, e.g., vinyl acetate, vinyl propionate, vinyl butyrate, and vinyl benzoate; α-methylene aliphatic monocarboxylic acid esters, e.g., methyl acrylate, ethyl acrylate, butyl acrylate, octyl acrylate, dodecyl acrylate, phenyl acrylate, methyl methacrylate, ethyl methacrylate, butyl methacrylate, and dodecyl methacrylate; vinyl ethers, e.g., vinyl methyl ether, vinyl ethyl ether, and vinyl butyl ether; and vinyl ketones, e.g., vinyl methyl ketone, vinyl hexyl ketone, and vinyl isopropenyl ketone.

Typical examples of the binder resins are polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, and polypropylene. Additionally, polyester resins, polyurethane resins, epoxy resins, silicone oils, polyamide resins, modified rosin, paraffins, and waxes are also employable.

The present invention is particularly effective where a polyester resin among the above-mentioned binder resins is used. A polyester resin is prepared by reacting a polyhydroxy compound and a polybasic carboxylic acid or a reactive derivative thereof.

The polyhydroxy compound constituting a polyester resin includes diols, e.g., ethylene glycol, diethylene glycol, triethylene glycol, 1,2-propylene glycol, 1,3-propylene glycol, 1,4-butanediol, and neopentylene glycol; hydrogenated bisphenol A; bisphenol A-alkylene oxide adducts, e.g., a bisphenol A-polyethylene oxide adduct and a bisphenol A-polypropylene oxide adduct; other dihydric alcohols; and dihydric phenols, e.g., bisphenol A.

The polybasic carboxylic acid component constituting a polyester resin includes malonic acid, succinic acid, adipic acid, sebacic acid, an alkylsuccinic acid, maleic acid, fumaric acid, mesaconic acid, citraconic acid, itaconic acid, glutaconic acid, cyclohexanedicarboxylic acid, phthalic acid, isophthalic acid, terephthalic acid, and other dicarboxylic acids, and reactive derivatives of these acids, such as acid anhydrides, alkyl esters, and acid halides.

These polybasic carboxylic acids may be used in combination with a tri- or higher polyhydroxy compound and/or a tri- or higher polybasic carboxylic acid so as to make the resulting polymer non-linear to such an extent that no tetrahydrofuran-insoluble content may occur.

The tri- or higher polyhydroxy compound and/or the tri- or higher polybasic carboxylic acid may be used in an amount of not more than 50 mol%, preferably 5 to 45 mol%, more preferably 10 to 30 mol%, based on the total amount of the acid used.

Examples of the tri- or higher polyhydroxy compound are sorbitol, 1,2,3,6-hexanetetrol, 1,4-sorbitan, pentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trimethylolbenzene.

Examples of the tri- or higher polybasic carboxylic acid are 1,2,4-butanetricarboxylic acid, 1,2,4-cyclohexanetricarboxylic acid, 1,2,4-benzenetricarboxylic acid, 1,2,5-benzenetricarboxylic acid, and 2,5,7-naphthalenetricarboxylic acid.

Preferred of the polyester resins prepared from the above-mentioned starting materials are linear polyester resins obtained by polycondensation of bisphenol A and an aromatic polycarboxylic acid as main monomer components.

The polyester resins which are particularly preferred in the present invention are those having a softening point of from 90° to 150° C., a glass transition point of from 50° to 70° C., a number average molecular weight of from 2,000 to 6,000, a weight average molecular weight of from 8,000 to 150,000, an acid value of from 5 to 30, and a hydroxyl value of from 5 to 40.

A preferred example of the polyester resin includes a polyester resin containing a diol component represented by the following general formula (I) as a constituent and having a softening point of 100° to 120° C., as measured by a ring and ball method, a glass transition temperature of 55° C. to 65° C., a Gardner color scale of 2 or less and a haze value of 15 or less,

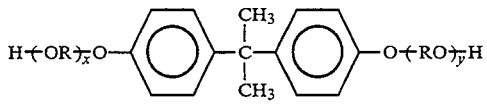

(I)

wherein R represents an ethylene group or a propylene group, each of x and y is an integer of 1 or more, and x+y is 2 to 6.

The toner particles preferably contain from 1 to 8 parts by weight of a colorant per 100 parts by weight of a binder resin. If the amount of the colorant is less than 1 part, the toner tends to have an insufficient coloring power. If it exceeds 8 parts, the toner tends to have reduced transparency.

The toner particles have an average particle size of not greater than about 30 μm, and preferably from 4 to 20 μm.

If desired, additives other than the surface-treated zinc oxide according to the present invention, such as a charge control agent, a fixing aid, a fluidity improving agent, a parting agent, a cleaning aid, and so forth, may be added to the toner particles.

It is essential that zinc oxide (ZnO) to be used as an additive adhered on the toner particles should be surface-treated. Untreated zinc oxide, as being an n-type semiconductor, causes a reduction in chargeability. On the contrary, surface-treated zinc oxide retains a high level of charge and also imparts excellent environmental stability to a toner. While the reason accounting for the improvements has not been made clear, it is assumed that the character of an n-type semiconductor remains after a surface treatment so that a narrow charge distribution and excellent toner admixing properties may be secured and that zinc oxide itself has excellent environmental stability.

The zinc oxide fine particles to be used in the present invention has an average particle size of from 2 to 100 nm, preferably from 2 to 50 nm, and more preferably from 3 to 30 nm. Further, they have a crystal form of hexagonal system, a specific surface area of from 50 to 70 $m^2/g$, a true specific gravity of from 5.50 to 6.00, a bulk specific gravity of from 0.35 to 0.45, an oil absorption of from 85 to 100 ml/g, and a refractive index of from 1.9 to 2.0. Zinc oxide fine particles satisfying these requirements are commercially available under a trade name of ZnO-100 (produced by Sumitomo Cement Co., Ltd.).

If desired, the zinc oxide fine particles may be used in combination with other additives, such as silica and alumina.

Surface treating agents which can be used for treating the surface of zinc oxide particles include silane coupling agents and silicone oils which are capable of reacting with a hydroxyl group.

The silane coupling agent to be used is preferably selected from those represented by the following formulae:

$R_{4-x}Si(NCO)_x$ $R'_{4-x}Si(OR'')_x$, and $R'''_{4-x}SiCl_x$ wherein R, R', and R''', which may be the same or different, each represent an alkyl group having from 1 to 16 carbon atoms or a perfluoroalkyl group having from 1 to 16 carbon atoms; R'' represents a methyl group, an ethyl group or a propyl group; and x represents an integer of from 1 to 3.

$C_{10}H_{21}Si(OCH_3)_3$ and $CF_3Si(OCH_3)_3$ may be mentioned as typical examples of these silane coupling agents. Of the above-described silane coupling agents, those wherein x is 3 are preferred for obtaining an increased quantity of charge. For the same reason, R, R', and R''' each preferably contain from 7 to 16 carbon atoms, and more preferably 10 to 16 carbon atoms.

The silicone oils which can be used in the present invention include dimethylsilicone, methylphenylsilicone, monomethylsilicone, and modified silicone oils.

Concrete examples of the silicone oils include methyl silicone oils KS-96, KS-99 and KS-2, amino modified silicone oil X-22-161, carboxyl modified silicone oil X-22-162A and methacryl modified silicone oil X-22-164C (commercially available from Shin-Etsu Kagaku Kogyo Co., Ltd.), and alkyl modified silicone oil SF 8416, amino modified silicone oil SF 8417 and fluorine modified silicone oil FS 1265 (commercially available from Toray Dau-Koningu Silicone Co., Ltd.).

These surface treating agents may be used either individually or in combination of two or more thereof. Further, they may be used in combination with other coupling agents, such as titanate coupling agents, aluminate coupling agents, and zirconium coupling agents.

The surface treating agent is used in an amount usually of at least 5% by weight, and preferably 10% by weight or more, based on zinc oxide particles. If the amount of the surface treating agent is less than 5% by weight, cases are sometimes met with in which the chargeability is reduced, and environmental stability of the toner composition is not sufficiently improved. The upper limit of the amount of the surface treatment agent used is 100% by weight, preferably 50% by weight, based on zinc oxide particles. The surface treating agent is more preferably used in an amount of 5 to 30 wt %, most preferably 10 to 20 wt % based on zinc oxide fine particles.

The surface-treated zinc oxide fine particles are added to toner particles in a proportion of from 0.5 to 4% by weight, and preferably from 0.5 to 3% by weight, based on the toner particles.

Additives other than zinc oxide fine particles may be further added to the surface of the toner in the present invention. Examples of the additives include silica, titania, tin oxide, polymethyl methacrylate fine particles and fluorine fine particles. Of them, silica fine particles are preferable for the purpose improving chargeability and fluidity of the toner. Particularly, silica fine particles obtained by vapor phase cracking process are more preferable. The silica fine particles have a specific surface area of at least 40 $m^2/g$, preferably 40 to 300 $m^2/g$ and have a primary particle size of not more than 50 nm, preferably 5 to 50 nm. Examples of these silica include A-300, A-200, A-130 and OX-50 (commercially available from Nippon Aerosil Co., Ltd.). These silica may be surface-treated by a hydrophobic property imparting agent or a various coupling agent such as a silane coupling agent. A example of the surface-treated silica fine particles is R-972 (commercially available from Nippon Aerosil Co., Ltd.). These silica can be used in an amount of about 0.5 to 4 wt %, preferably 0.5 to 2 wt % based on the total amount of the toner.

Adhesion of the external additive(s) onto the surface of toner particles is performed by mixing them by means of, for example, a high-speed mixing apparatus, such as a Henschel mixer or a twin-cylinder mixer.

According to the present invention, external addition of the surface-treated zinc oxide particles onto toner particles makes it possible to improve uniformity of the charge on the surface of toner particles and charge exchangeability among toner particles thereby increasing the rate of charging and making a sharp charge distribution while retaining toner chargeability necessary for development even in a high temperature and high humidity atmosphere. It follows that the toner composition of the present invention exhibits markedly reduced environmental dependence. In particular, where a polyester resin is used as a binder resin, the aforesaid disadvantage of a polyester resin, i.e., environment dependence of chargeability, can be eliminated.

The electrophotographic toner composition of the present invention includes one-component developers containing no carrier and two-component developers containing a carrier, with the latter being preferred.

Carriers which can be used in the two-component developers are not particularly limited, and any known carriers, such as an iron powder-based carrier, a ferrite-based carrier, a surface-coated ferrite carrier, and a magnetic powder-dispersed carrier, may be employed.

The present invention will now be illustrated in greater detail with reference to Examples, but the present invention should not be construed as being limited thereto. All the percents and parts are by weight unless otherwise indicated.

EXAMPLE 1

1) Preparation of Toner Particles

1—1) Toner A

| | |
|---|---|
| Styrene-n-butyl methacrylate copolymer (glass transition point (Tg): 65° C.: number average molecular weight (Mn): 15,000; weight average molecular weight (Mw): 35,000) | 100 parts |
| Magenta pigment (C.I. Pigment Red 57) | 3 parts |
| Potassium tetraphenylborate | 1 part |

The above components were kneaded in an extruder, ground in a jet mill, and classified in an air classifier to obtain magenta toner particles having an average particle diameter $d_{50}$ of 8 $\mu$m.

1-2) Toner B

| | |
|---|---|
| Linear polyester resin (terephthalic acid-bisphenol A ethylene oxide adduct- | 100 parts |

-continued

| | |
|---|---|
| cyclohexanedimethanol polycondensate; Tg: 62° C.; Mn: 4,000; Mw: 35,000; acid value: 12; hydroxyl value: 25) | |
| Magenta pigment (C.I. Pigment Red 57) | 3 parts |

Magenta toner B was obtained from the above components in the same manner as for toner A.

2) Preparation of Additives

2—1) Additive a

In a mixed solvent of methanol/water (95:5 by volume) was dissolved 1.0 g of decyltrimethoxysilane, and 10 g of fine powder of zinc oxide having an average particle diameter of 9 nm (ZnO-100, produced by Sumitomo Cement Co., Ltd.) was added thereto, followed by ultrasonification. The solvent was removed from the resulting dispersion in an evaporator, and the residue was dried, heat-treated in a drier set at 120° C., and ground in an automatic mortar to obtain decyltrimethoxysilane-treated zinc oxide fine particles.

2—2) Additive b

In toluene was dissolved 2.0 g of silicone oil KF 99 produced by Shin-Etsu Chemical Co., Ltd., and 10 g of the same zinc oxide powder as used in (2-1) above was added to the solution, followed by ultrasonification. The solvent was removed from the resulting dispersion in an evaporator, and the residue was dried, heat-treated in a drier set at 140° C., and ground in an automatic mortar to obtain silicone oil-treated zinc oxide.

2-3) Additive c

Decyltrimethoxysilane-treated zinc oxide was prepared in the same manner as for additive a, except for replacing ZnO-100 (average particle size: 9 nm) with ZnO-200 (produced by Sumitomo Cement Co., Ltd.) having an average particle size of 15 nm.

3) Preparation of Toner Compositions 3-1) Toner Compositions 1 and 2

A hundred parts of toner A and 1.5 parts of additive a or b were mixed in a high-speed mixer to prepare toner composition 1 or 2, respectively.

3—2) Toner Compositions 3 and 4

A hundred parts of toner B and 1.5 parts of additive a or b were mixed in a high-speed mixer to prepare toner composition 3 or 4, respectively.

3—3) Toner Composition 5

A hundred parts of toner B was mixed with 0.8 part of additive a and 0.6 part of silica fine powder ("R 972" produced by Nippon Aerosil Co., Ltd.) in a high-speed mixer to prepare toner composition 5.

3-4) Toner Compositions 6

A hundred parts of toner B and 1.5 parts of additive c were mixed in a high-speed mixer to obtain toner composition 6.

4) Preparation of Developers

Six parts of each of toner compositions 1 to 6 were added to 100 parts of a styrene-methyl methacrylate copolymer-coated ferrite carrier having a particle size of about 50 μm, and the mixture was mixed in a tumbler shaker mixer to obtain developers 1 to 6, respectively.

COMPARATIVE EXAMPLE 1

1) Preparation of Additives

1—1) Additive d

In a mixed solvent of methanol/water (95:5 by volume) was dissolved 0.1 g of decyltrimethoxysilane, and 10 g of fine powder of zinc oxide having an average particle diameter of 0.67 μm (Sazex #2000, produced by Sakai Chemical Industry Co., Ltd.) was added to the solution, followed by ultrasonification. The resulting dispersion was worked-up in the same manner as for additive a to obtain decyltrimethoxysilane-treated zinc oxide powder.

1-2) Additive e

Decyltrimethoxysilane-treated zinc oxide powder was prepared in the same manner as for additive d, except for increasing the amount of decyltrimethoxysilane to 1.0 g. The resulting powder obviously contained insufficiently ground coarse particles.

1-3) Additive f

Decyltrimethoxysilane-treated titanium oxide fine powder was prepared in the same manner as for additive a of Example, except for replacing ZnO-100 (average particle size: 9 nm) with amorphous titanium oxide having an average particle size of 15 nm (OFP, produced by Idemitsu Kosan Co., Ltd.).

2) Preparation of Toner Compositions 2-1) Toner Composition 7

A hundred parts of toner B of Example 1 were mixed with 1.5 parts of untreated zinc oxide (ZnO-100) at a high speed to prepare toner composition 7.

2—2) Toner Composition 8

A hundred parts of toner B of Example 1 were mixed with 1.0 part of hydrophobic silica fine powder (R 972) at a high speed to prepare toner composition 8.

2-3) Toner Composition 9

A hundred parts of toner B of Example 1 were mixed with 1.5 parts of additive d at a high speed to prepare toner composition 9.

2-4) Toner Composition 10

A hundred parts of toner B of Example 1 were mixed with 1.5 parts of additive e at a high speed to prepare toner composition 10.

2-5) Toner Composition 11

A hundred parts of toner B of Example 1 were mixed with 1.0 part of additive f at a high speed to prepare toner composition 11.

2-6) Toner Composition 12

A hundred parts of toner B of Example 1 were mixed with 1.5 parts of untreated zinc oxide (Sazex #2000) at a high speed to prepare toner composition 12.

3) Preparation of Developers

Developers 7 to 12 were prepared in the same manner as in Example 1, except for using each of toner compositions 7 to 12.

Each of developers 1 to 6 of Example 1 and developers 7 to 12 of Comparative Example 1 was subjected to a copying test using an electrophotographic copying machine "A-Color 630" manufactured by Fuji Xerox Co., Ltd. to determine the quantity of charge, the charge distribution, and the amount of the toner charged to the opposite polarity in a high temperature and high humidity atmosphere (30° C., 85% RH) or a low temperature and low humidity atmosphere (10° C., 15% RH). The measurements were taken after the toner composition and the carrier were mixed for 1 minute. The quantity of charge was measured through image analysis by CSG (charge spectrography). The charge distribution was obtained from equation:

$$\text{Charge Distribution} = \{Q(80) - Q(20)\}/Q(50)$$

wherein Q(20), Q(50), and Q(80) are 20%, 50% and 80% quantity of charge in the cumulative charge distribution curve. The results obtained are shown in Table 1 below.

Further, 2.0 parts of the respective toner was added to 100 parts of each developer. After mixing for 5 seconds, the same measurements as described above were made to evaluate toner admixing properties. The results obtained are shown in Table 2 below.

TABLE 1

| | After 1 min's Mixing of Toner and Carrier | | | | | |
|---|---|---|---|---|---|---|
| | 30° C., 85% RH | | | 10° C., 15R RH | | |
| Developer No. | Quantity of Charge (μC/g) | Charge Distribution | Amount of Toner of Opposite Polarity (wt %) | Quantity of Charge (μC/g) | Charge Distribution | Amount of Toner of Opposite Polarity (wt %) |
| 1 | −17.3 | 0.5 | 0 | −23.5 | 0.6 | 0 |
| 2 | −16.2 | 0.5 | 0 | −21.5 | 0.6 | 0 |
| 3 | −-18.5 | 0.5 | 0 | −25.3 | 0.6 | 0 |
| 4 | −14.9 | 0.5 | 0 | −19.1 | 0.6 | 0 |
| 5 | −20.4 | 0.6 | 0 | −26.9 | 0.7 | 0 |
| 6 | −18.0 | 0.7 | 0 | −25.1 | 0.6 | 0 |
| 7 | −4.2 | — | 27 | −8.8 | — | 21 |
| 8 | −16.2 | 0.6 | 0 | −29.9 | 0.7 | 0 |
| 9 | −7.5 | 0.7 | 5 | −15.3 | 0.7 | 0 |
| 10 | −13.3 | 0.8 | 5 | −19.3 | 0.8 | 0 |
| 11 | −18.1 | 0.7 | 0 | −25.0 | 0.7 | 0 |
| 12 | −5.1 | — | 30 | −8.9 | — | 23 |

TABLE 2

| | Toner Admixing Properties (after 5 sec' mixing from toner addition) | | | | | |
|---|---|---|---|---|---|---|
| | 30° C., 85% RH | | | 10° C., 15R RH | | |
| Developer | Quantity of Charge (μC/g) | Charge Distribution | Amount of Toner of Opposite Polarity (wt %) | Quantity of Charge (μC/g) | Charge Distribution | Amount of Toner of Opposite Polarity (wt %) |
| 1 | −15.3 | 0.6 | 0 | −20.1 | 0.7 | 0 |
| 2 | −14.2 | 0.6 | 0 | −18.6 | 0.6 | 0 |
| 3 | −13.9 | 0.6 | 0 | −22.3 | 0.6 | 0 |
| 4 | −12.3 | 0.6 | 0 | −16.8 | 0.7 | 0 |
| 5 | −17.2 | 0.7 | 0 | −22.1 | 0.7 | 0 |
| 6 | −15.3 | 0.7 | 0 | −19.8 | 0.7 | 0 |
| 7 | −2.0 | — | 41 | −6.5 | — | 35 |
| 8 | −13.8 | 0.6 | 15 | −22.6 | 0.8 | 13 |
| 9 | −4.0 | — | 20 | −10.5 | 0.9 | 23 |
| 10 | −5.9 | 1.0 | 18 | −17.0 | 0.9 | 17 |
| 11 | −15.3 | 0.7 | 0 | −20.5 | 0.6 | 0 |
| 12 | −1.3 | — | 50 | −5.9 | — | 33 |

As is apparent from the results in Tables 1 and 2, developers 1 to 6 according to the present invention show substantially no change in quantity of charge with the change of the environmental conditions and exhibit a very sharp distribution of charge quantity.

When 8,000 copies were taken using these developers, images were stably obtained in general without undergoing variations in image density or background stains, with the exception that slight contamination of the inside of the copying machine was observed in using developer 4.

To the contrary, in using developers 7 and 12 in which untreated zinc oxide was used as an external additive for toner particles and developers 9 and 10 in which surface-treated zinc oxide having a relatively large particle size was used, the quantity of charge was too small to withstand use. In particular, toner composition 10 caused noticeable contamination of the copying machine with a white powder. Toner composition 8 using hydrophobic silica underwent large variation in charge quantity with change of the environment, had a broad charge quantity distribution, and made a poor rise of charge when the developer was replenished with a fresh toner. As a result, developer 10 caused large variation in image density with change of the environment, and background stains and cloud occurred.

While developer 11 using surface-treated amorphous titanium oxide did not give rise to any conspicuous problem in the test conducted after 1 minute's mixing (see Table 1), the charge distribution of developer 11 was rapidly broadened in the running test and caused serious contamination of the copying machine and background stains.

EXAMPLE 2

| | |
|---|---|
| Styrene-n-butyl methacrylate (70:30) copolymer (Mn: ca. 7,000; Mw: ca. 40,000) | 97 parts |
| Cyan pigment (β-type phthalocyanine; C.I. Pigment Blue 15:3) | 3 parts |

The above components were melt-kneaded, pulverized, and classified to obtain cyan toner particles having $d_{50}$ of 8 μm.

A hundred parts of the cyan toner particles and 0.9 part of additive b prepared in Example 1 were mixed in a high-speed mixer to prepare a cyan toner composition. The resulting cyan toner composition exhibited satisfactory fluidity.

Six parts of the cyan toner composition were mixed with 100 parts of a styrene-methyl methacrylate copolymer-coated ferrite carrier having a particle size of about 50 μm to prepare a developer.

A copying test of the developer was carried out using the same copying machine as used in Example 1 under environmental conditions varying from a high temperature and high humidity condition (30° C., 85% RH) to a low temperature and low humidity condition (10° C., 15% RH). As a result, a satisfactory cyan image having a high density and free from background stains could be obtained from the initial stage. Virtually no change in image quality was observed even when 8,000 copies were consecutively taken.

EXAMPLE 3

Magenta toner particles having an average particle size of 8 μm were prepared in the same manner as in Example 2, except for replacing the cyan pigment with a magenta pigment (Brilliant Carmine 6BC, C.I. Pigment Red 57).

A hundred parts of the magenta toner particles and 1.0 part of additive b prepared in Example 1 were mixed in a high-speed mixer to prepare a magenta toner composition. The resulting magenta toner composition exhibited satisfactory fluidity.

A magenta developer was prepared in the same manner as in Example 2, except for replacing the cyan toner composition with the above prepared magenta toner composition.

EXAMPLE 4

Yellow toner particles, a yellow toner composition, and then a yellow developer were successively prepared in the same manner as in Example 3, except for replacing the magenta pigment with a yellow pigment (Disazo Yellow, C.I. Pigment Yellow 12). The resulting yellow toner composition exhibited satisfactory fluidity.

A copying test of the developers prepared in Examples 3 and 4 was carried out in the same manner as in Example 2. A satisfactory image of high density and free from background stains was obtained irrespective of the environmental changes. Virtually no change in image quality was observed even when 8,000 copies were consecutively taken.

As described above, the electrophotographic toner composition according to the present invention is characterized in that zinc oxide fine particles having been surface-treated with a silane coupling agent or a silicone oil are adhered to the surface of toner particles. According to the present invention, charging properties, especially environmental stability, of toner particles are improved, and the charge distribution can be kept narrow even under environmental conditions varying from high to low temperature and from high to low humidity. Besides, even when used continuously for an extended period of time, the toner composition maintains a high charge quantity with suppressed occurrence of toner particles charged to opposite polarity and provides fog-free images with stable quality.

While the invention has been described in detail and with reference to specific examples thereof, it will be apparent to one skilled in the art that various changes and modifications can be made therein without departing from the spirit and scope thereof.

What is claimed is:

1. An electrophotographic toner composition comprising toner particles containing a binder resin and a colorant and fine particles adhered to the exposed surface of the toner particles, in which said fine particles are zinc oxide fine particles having an average particle size of from 2 to 100 nm and having been surface-treated with a silane coupling agent or a silicone oil.

2. An electrophotographic toner composition as claimed in claim 1, wherein said silane coupling agent is selected from the group consisting of compounds of formulae:

$$R_{4-x}Si(NCO)_x$$

$$R'_{4-x}Si(OR'')_x, \text{ and}$$

$$R'''_{4-x}SiCl_x$$

wherein R, R′, and R‴, which may be the same or different, each represent an alkyl group having from 1 to 16 carbon atoms or a perfluoroalkyl group having from 1 to 16 carbon atoms; R″ represents a methyl group, an ethyl group or a propyl group; and x represents an integer of from 1 to 3.

3. An electrophotographic toner composition as claimed in claim 1, wherein said fine particles are zinc oxide fine particles having been surface-treated with a silane coupling agent selected from the group consisting of compounds formulae:

$$R_{4-x}Si(NCO)_x$$

$$R'_{4-x}Si(OR'')_x, \text{ and}$$

$$R'''_{4-x}SiCl_x$$

wherein R, R′, and R‴, which may be the same or different, each represent an alkyl group having from 7 to 16 carbon atoms or a perfluoroalkyl group having from 7 to 16 carbon atoms; R″ represents a methyl group, an ethyl group or a propyl group; and x represents an integer of from 1 to 3.

4. An electrophotographic toner composition as claimed in claim 1, wherein said zinc oxide fine particles have been treated with at least 5% by weight of said saline coupling agent or silicone oil based on zinc oxide fine particles.

5. An electrophotographic toner composition as claimed in claim 1, wherein said zinc oxide fine particles have been treated with at least 10% by weight of said silane coupling agent or silicone oil based on zinc oxide fine particles.

6. An electrophotographic toner composition as claimed in claim 1, wherein said binder resin is a polyester resin.

7. An electrophotographic toner composition as claimed in claim 1, wherein the zinc oxide fine particles have an average particle size of from 2 to 50 nm.

8. An electrophotographic toner composition as claimed in claim 1, wherein the zinc oxide fine particles have an average particle size of from 3 to 30 nm.

9.An electrophotographic toner composition as claimed in claim 1, wherein the zinc oxide fine particles have a specific surface area of from 50 to 70 $m^2/g$.

10. An electrophotographic toner composition as claimed in claim 1, wherein the zinc oxide fine particles have a true specific gravity of from 5.50 to 6.00.

11. An electrophotographic toner composition as claimed in claim 1, wherein the zinc oxide fine particles have a bulk specific gravity of from 0.35 to 0.45.

12. An electrophotographic toner composition as claimed in claim 1, wherein the zinc oxide fine particles have an oil absorption of from 85 to 100 mL/g.

13. An electrophotographic toner composition as claimed in claim 1, wherein the zinc oxide fine particles have a refractive index of from 1.9 to 2.0.

14. An electrophotographic toner composition as claimed in claim 2, wherein R, R′ and R‴ each have from 7 to 16 carbon atoms.

15. An electrophotographic toner composition as claimed in claim 2, wherein R, R′ and R‴ each have from 10 to 16 carbon atoms.

16. An electrophotographic toner composition as claimed in claim 1, wherein the silicone oil is selected from the group consisting of dimethylsilicone, methylphenylsilicone and monomethylsilicone.

17. An electrophotographic toner composition as claimed in claim 1, wherein the zinc oxide fine particles are present in a proportion of from 0.5 to 4% by weight, based on the toner particles.

18. An electrophotographic toner composition as claimed in claim 1, wherein the zinc oxide fine particles are present in a proportion of from 0.5 to 3% by weight, based on the toner particles.

19. An electrophotographic toner composition as claimed in claim 1, wherein the toner composition further comprises another external additive.

* * * * *